United States Patent [19]

Verhoeven

[11] Patent Number: 4,983,262

[45] Date of Patent: Jan. 8, 1991

[54] CONVERSION COMPOSITION AND PROCESS

[75] Inventor: Peter Verhoeven, 's-Hertogenbosch, Netherlands

[73] Assignee: OMI International Corporation, Warren, Mich.

[21] Appl. No.: 482,116

[22] Filed: Feb. 16, 1990

[30] Foreign Application Priority Data

Feb. 27, 1989 [GB] United Kingdom ..... 8904434
Sep. 27, 1989 [GB] United Kingdom ..... 8921788

[51] Int. Cl.[5] ..... C25D 11/38

[52] U.S. Cl. ..... 204/38.4; 204/40; 204/56.1; 204/DIG. 9

[58] Field of Search ..... 204/35.1, 38.1, 38.4, 204/40, 41, 56.1, DIG. 9

[56] References Cited

U.S. PATENT DOCUMENTS 3,876,435 4/1975 Dollman ..... 106/14.12
3,982,951 9/1976 Palagos ..... 106/14.21
3,998,601 12/1976 Yates et al. ..... 428/607
4,003,760 1/1977 Labenski et al. ..... 148/265
4,137,132 1/1979 Ward et al. ..... 204/38.1
4,591,416 5/1986 Kamitani et al. ..... 204/35.1

OTHER PUBLICATIONS

Metal Finishing Guidebook and Directory for 1978, Metals and Plastics Publications, Inc., Hackensack, N.J.; pp. 555–571.

*Primary Examiner*—John F. Niebling
*Assistant Examiner*—William T. Leader
*Attorney, Agent, or Firm*—Richard P. Mueller

[57] ABSTRACT

The production of uniformly blackened nickel deposits for decorative or functional purposes can be achieved by depositing nickel from an electroless nickel plate composition or electrolytically followed by forming a conversion coating on the electroless nickel deposit in a chromate bath which includes nitrate ions.

6 Claims, No Drawings

CONVERSION COMPOSITION AND PROCESS

This invention relates to the production of a black conversion coating on an electroless or electroplated nickel phosphorus deposit.

Electroless nickel plating has been known for some time. Articles coated with an electroless nickel deposit are disclosed, for example, in US-A-3088846. There is at present a general commercial need, dictated partly by questions of fashion, for black electroless nickel deposits, primarily but not exclusively for decorative use. Such deposits are typically required on, for example, exposed metal components and/or casing of televisions, video cassette recorders and hi-fi equipment, and may alternatively be produced by electrolytic deposition.

EP-A-0094127 proposes a solution to the problem of producing black electroless nickel deposits. It discloses that an electroless nickel-coated article can be treated in a bath comprising chromate ions, phosphate ions and optionally sulphate ions and subjected to periodically reversed current. Unfortunately, the results obtained are not always satisfactory, in that the black conversion coating formed is not always sufficiently uniform.

It has now been discovered that nitrate ions in a conversion composition can improve the conversion process and the end result: the uniformity of the black film obtained is enhanced, especially in the high and low current density areas, which are particularly prone to variation. The conversion composition can equally be effective on nickel deposits produced electrolytically.

According to a first aspect of the present invention, there is provided a composition suitable for forming a conversion layer on a nickel deposit, the composition comprising chromate ions and nitrate ions. Phosphate ions and optionally sulphate ions may also be present.

The deposit may be an electroless or electrolytic deposit. Because, in an electroless plating process the metal ions are reduced to metal by a chemical reducing agent rather than by electricity, an electroless metal (eg nickel) deposit may in fact be an alloy of the metal and some other element, for example from the reducing agent itself. In the case where nickel is reduced by sodium hypophosphite, a nickel-phosphorus alloy is formed, and this is itself desirable as the phosphorus imparts good corrosion resistance to the deposit. In an electrolytic bath, the reducing power is supplied electrolytically, rather than chemically, and so there is no need from the point of view of operating the bath to include a phosphorus-containing ion. However, it is still desirable to obtain a nickel phosphorus alloy, and so a source of phosphorus, such as phosphate or phosphite ions will usually be incorporated. It is to be understood that such alloys are included within the meaning of the expression "nickel deposit".

The nitrate ions may be added as nitric acid, but it is to be understood that the species present will of course depend on the pH of the composition. Nitrate ions provided by the addition of from 1 to 15ml/1 nitric acid (65%) may be suitable with those provided by the addition of 5 to 10ml/1 nitric acid being preferred. The addition of nitric acid in an amount of about 7.5ml/1 has been found experimentally to provide the optimum results.

The composition may comprise phosphate ions and optionally sulphate ions and be capable of forming a layer of a hydrated basic chromium phosphate which comprises the components $CrPO_4$ and $Cr(OH)_3$, wherein $Cr_2(SO_4)_3$ may be present, and in which the weight ratio Cr:P:S =1:(0.2–1.5):(0–0.5). The weight ratio Cr:P:S may be 1:1:(0–0.2).

An electroless nickel deposit may be produced by any convenient technique, including the use of commercially available electroless nickel plating baths. The electroless nickel plating composition described and claimed in UK Patent Application No. 8904435.8, filed on Feb. 27, 1989 may also be used. The subject matter of that co-pending application is, to the extent that the law allows, herein incorporated by reference. The electroless nickel plating process may take place under appropriate conditions, which will be apparent to those skilled in the art and/or supplied by the manufacturer of commercially available plating baths.

Electrolytically deposited nickel may also be produced by any convenient technique, including the use of published and commercially available electroless nickel phosphorus plating baths. A suitable nickel-phosphorus bath, for example is disclosed in Semones & Safraneck, *Die Casting Engineer* 17(6) NoV/Dec 1973 and contains:

| | |
|---|---|
| $NiSO_4.6H_2O$ | 175 g/l |
| $NiCl_2.6H_2O$ | 50 g/l |
| $H_3PO_4$ | 50 g/l |
| $H_3PO_3$ | 15 g/l |

Such a bath can be operated under the following conditions:

| | |
|---|---|
| pH | 0.8–1.5 |
| Temp | 75° C. |
| Current density | 2–5 ASD |

According to a second aspect of the invention, there is provided a process for preparing a black nickel deposit, the process comprising forming a nickel deposit on an article and forming a conversion layer by treating the coated article in an aqueous composition containing chromate ions and nitrate ions, in which composition the article is connected as an electrode which is subjected to periodically reversed current. The nickel deposit may be prepared by electroless techniques or electrolytically.

The periodically reversed current conditions in the conversion treatment may generally be as described in EP-A-0094127, which, insofar as the law allows, is herein incorporated by reference. The periodically reversed current frequency may be from 0.1 to 50Hz, for example from 0.5 to 25Hz, typically about 1Hz.

The ratio of the time for which the electroless nickel plated article is the cathode and the time in which it is the anode for a given current cycle ($t_{cat}/t_{an}$) need not be equal to 1. A $t_{cat}/t_{an}$ ratio of from 0.05 to 20 may in general be suitable, but a $t_{cat}/t_{an}$ ratio of less than 1 is preferred. $T_{cat}/t_{an}$ ratios of between 0.1 and 0.8 inclusive have been found to be the most acceptable.

The current density in the conversion compositions may range from 0.1 to 1 ASD, for example 0.2 to 0.5 ASD, and is typically about 0.25 ASD.

Chromate ions may be present in the conversion composition in an amount of from 1 to 40g/1 $CrO_3$, for example from 2 to 20g/1, typically 5 to 15g/1. The amount of phosphate ions may be present in an amount provided by from 1 to 60ml/1 concentrated phosphoric acid, typically from 2 to 40ml/1, with amounts of from 10 to 30ml/1 being preferred. Sulphate ions may be provided by from 0 to 10ml/1 concentrated sulphuric acid, typically 0.1 to 5ml/1 sulphuric acid, with amounts of from 0.5 to 3ml/1 being preferred.

Other preferred features of the process of this invention are as for the composition. Further preferred features of the composition and process of this invention are described in EP-A-0094127.

The invention will now be illustrated by the following examples.

EXAMPLE 1

A steel panel on which an electroless nickel deposit had been plated was immersed in an aqueous solution of the following formulation:

| | |
|---|---|
| $CrO_3$ | 10 g/l |
| $H_3PO_4$ (85%) | 20 ml/l |
| $H_2SO_4$ (98%) | 2 ml/l |
| $HNO_3$ (65%) | 7.5 ml/l |

The plated steel panel was subjected to a periodically reversing current generally as described in EP-A-0094127, but using the following specific parameters:

| | |
|---|---|
| Anodic time | 0.8 seconds |
| Cathodic time | 0.2 seconds |
| Current density | 0.25 ASD |
| Temperature | 20–22° C. |

The electrolytic treatment continued for 30 minutes. A black film was obtained that was totally uniform, even in the high and low current density areas.

COMPARISON EXAMPLE

The procedure of the above example was followed, except that the nitric acid was omitted from the composition. After 30 minutes electrolytic treatment, a black film was obtained, but the uniformity was poor particularly in the high and low current density areas.

EXAMPLE 2

A steel panel on which a nickel deposit had been formed electrolytically in a bath containing:

| | |
|---|---|
| $NiSO_4.6H_2O$ | 175 g/l |
| $NiCl_2.6H_2O$ | 50 g/l |
| $H_3PO_4$ | 50 g/l |
| $H_3PO_3$ | 15 g/l |

at pH 1.1, 75° C. and 3.5 ASD was treated as in Example 1 to yield a closely similar result.

What is claimed is:

1. A process for preparing a black nickel deposit, the process comprising forming a nickel deposit on an article and forming a conversion layer by treating said article on which a nickel deposit has been formed in an aqueous composition containing chromate ions and nitrate ions, in which composition the article is connected as an electrode which is subjected to periodically reversed current.

2. A process as claimed in claim 1, wherein the periodically reversed current frequency is from about 0.5 to about 25Hz.

3. A process as claimed in claim 1, wherein the ratio of the time for which the electroless nickel plated article is the cathode and the time in which it is the anode for a given current cycle ($t_{cat}/t_{an}$) is between about 0.1 and about 0.8 inclusive.

4. A process as claimed in claim 1, wherein chromate ions are present in the conversion composition in an amount of from about 2 to about 20g/1 $CrO_3$.

5. A process as claimed in claim 1, wherein phosphate ions are present in the conversion composition in an amount as would be provided by from about 2 to about 40ml/1 concentrated phosphoric acid.

6. A process as claimed in claim 1, wherein sulphate ions are present in the conversion composition in an amount as would be provided by from about 0.1 to about 5ml/1 concentrated sulphuric acid.

* * * * *